United States Patent [19]

Roccaforte

[11] 4,307,835

[45] Dec. 29, 1981

[54] PAPER DISH WITH CONICAL COMPARTMENT

[75] Inventor: Harry I. Roccaforte, Western Springs, Ill.

[73] Assignee: Champion International Corporation, Stamford, Conn.

[21] Appl. No.: 166,260

[22] Filed: Jul. 7, 1980

[51] Int. Cl.[3] ..... B65D 5/20

[52] U.S. Cl. ..... 229/30; 229/18; 229/41 D

[58] Field of Search ..... 229/30, 4.5, 18, 41 D

[56] References Cited

U.S. PATENT DOCUMENTS

| | | | |
|---|---|---|---|
| 1,476,910 | 12/1923 | Nangle | 229/30 |
| 2,007,523 | 7/1935 | Emery | 229/30 |
| 2,210,566 | 8/1940 | Bockman | 229/30 |
| 2,762,547 | 9/1956 | Van Dyke | 229/30 |
| 2,763,421 | 9/1956 | Bennett | 229/30 |
| 2,992,765 | 7/1961 | Kram | 229/30 |
| 3,561,453 | 2/1971 | Kline | 229/30 |
| 3,907,195 | 9/1975 | Struhle | 229/41 D |

*Primary Examiner*—Herbert F. Ross
*Attorney, Agent, or Firm*—Evelyn M. Sommer

[57] ABSTRACT

A fast food carton having a food-receiving tray portion provided with an inverted, conical, central depression for receiving a liquid sauce. The tray includes a pair of relatively inverted, truncated conical portions concentric with the central depression to receive the food. A cover element is hingedly connected to the circumference of the tray.

14 Claims, 9 Drawing Figures

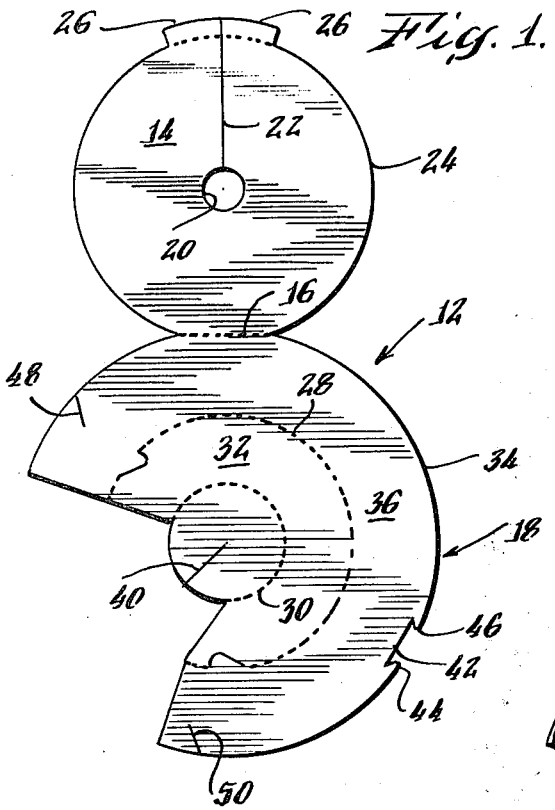
Fig. 1.
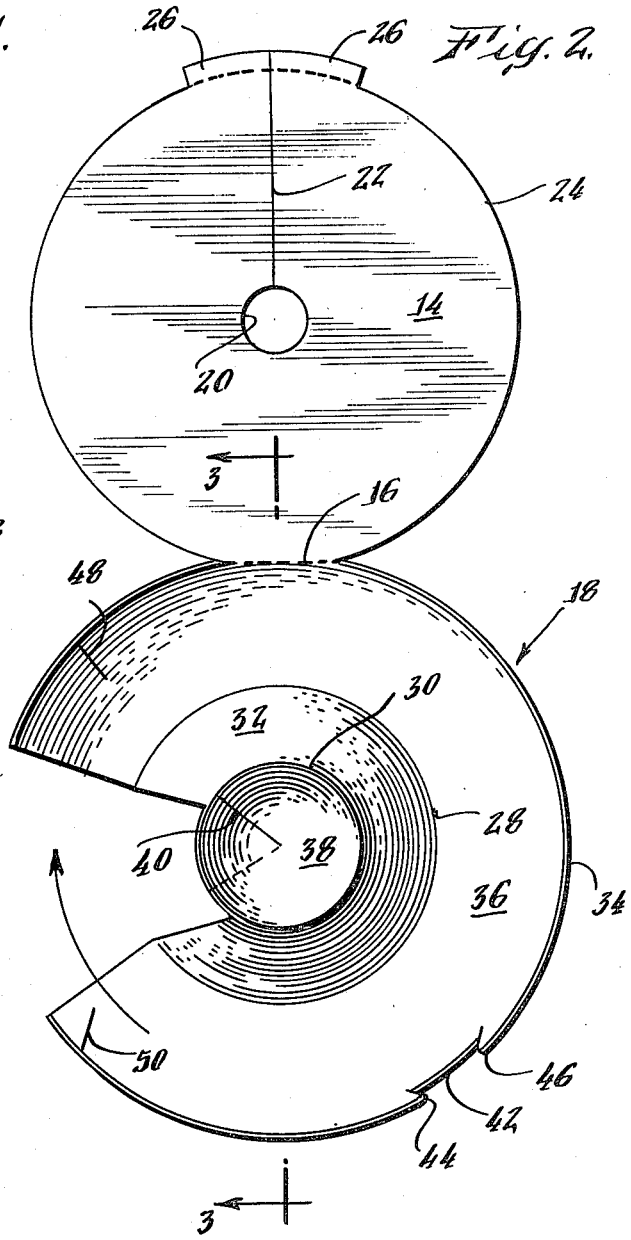
Fig. 2.
Fig. 4.
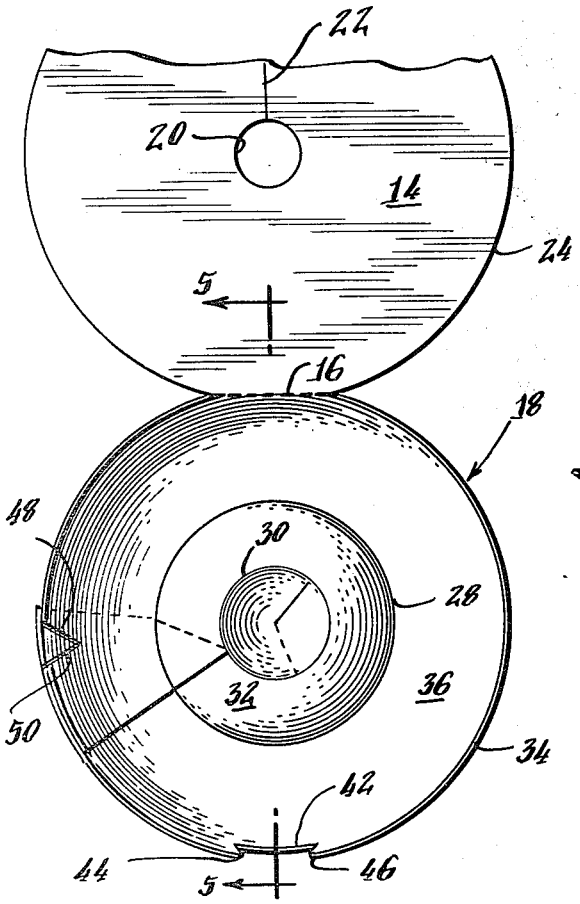
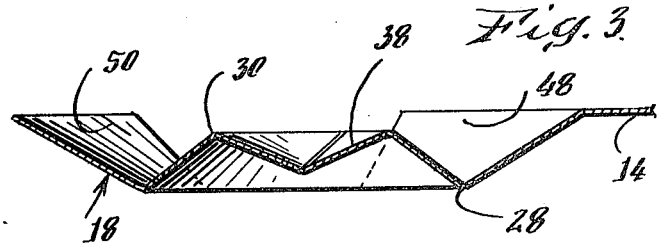
Fig. 3.
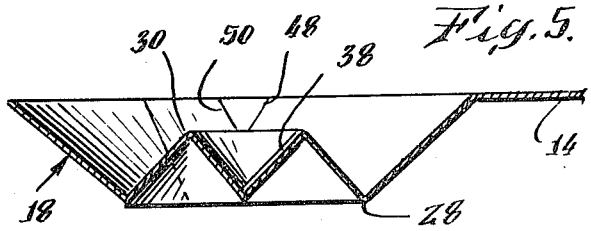
Fig. 5.

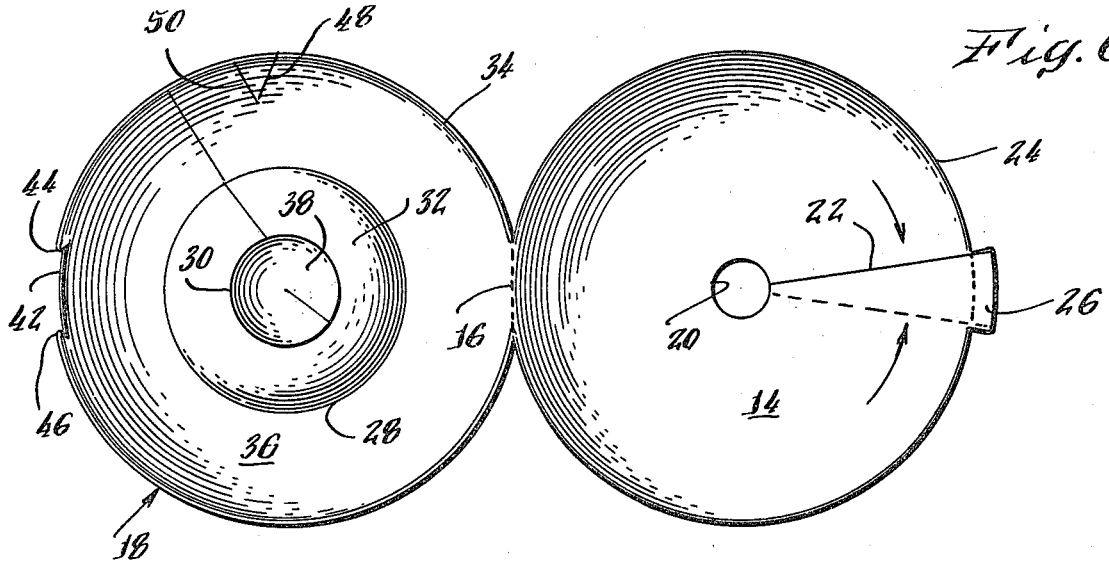
Fig. 6.
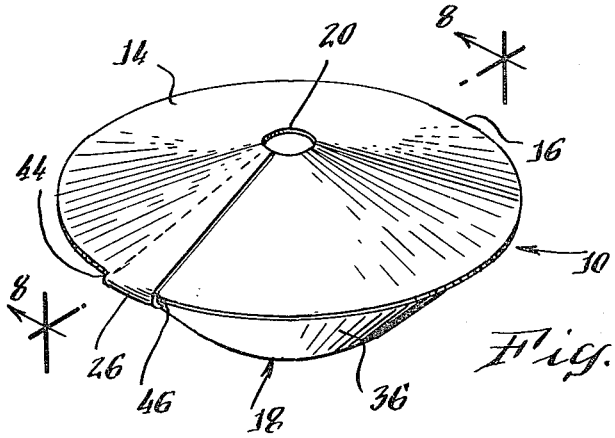
Fig. 7.
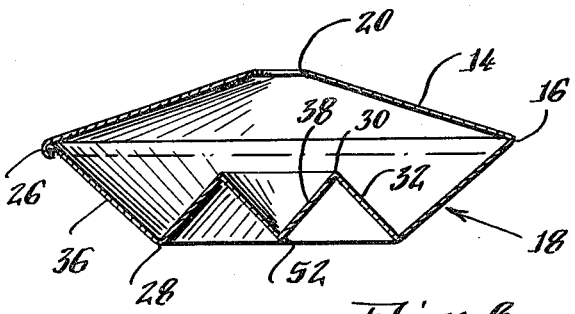
Fig. 8.
Fig. 9.
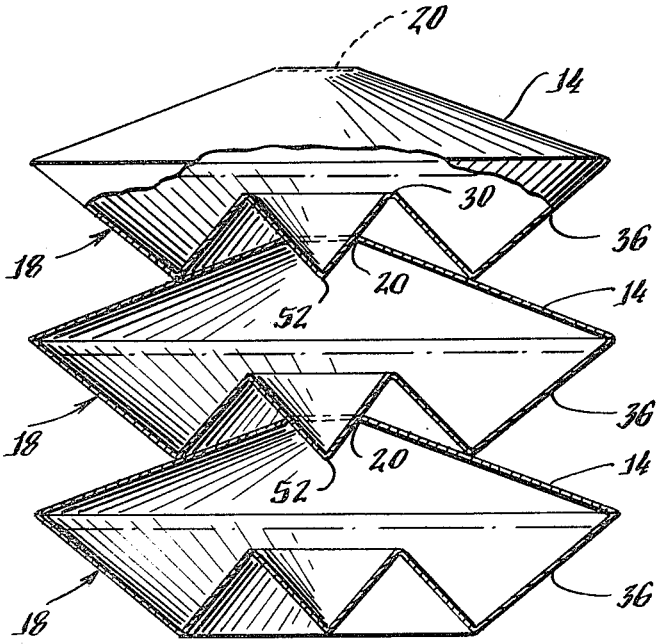

PAPER DISH WITH CONICAL COMPARTMENT

BACKGROUND OF THE INVENTION

1. Field of the Invention

This invention relates to a food carton, and more particularly, a food carton for use by fast food restaurants to house and serve fried foods and the like which are dipped in a liquid sauce.

2. Description of the Prior Art

Fast food restaurants serve pieces of fried fish, chicken, onion rings, french fries, and the like in a container. The container usually comprises an open-ended package for receiving the food. Some packages have consisted of a tray formed from expanded polystyrene or paperboard provided with a hinged lid to maintain the food at a warm temperature when sold to the customer.

It is common to provide a sauce, such as ketchup, tartar sauce, mustard, or the like with foods of the type indicated sold by fast food restaurants. These sauces are provided in individual packages or on an open counter in a bottle. In either event, the package must be opened and dispensed or the sauce dispensed from the bottle onto some surface adjacent to the package so that the contents of the food package can be dipped in the sauce as it is eaten. Fast food packages do not contain a separate compartment for holding such a sauce into which the food is to be dipped. Ordinarily, the consumer will squirt the sauce on a napkin and dunk the food into the sauce or a separate open container must be provided. Further, to provide the expanded polystyrene package in which such foods are dispensed with a compartment for holding a sauce would be highly costly.

SUMMARY OF THE INVENTION

In accordance with the present invention, a paperboard food carton is provided which is formed with a centrally located inverted conical compartment for holding a quantity of a sauce. Surrounding the inverted conical center portion are relatively, inverted, truncated frustoconical portions forming a deep dish for receiving a variety of food items to be sold in the carton, for use with the sauce. Integrally connected to the upper edge of the second, relatively inverted frustoconical portion of the carton dish or base member along a circumferential edge, is a cover which is either flat or also conical in shape. Interlocking tabs on the upper edge of the second relatively inverted truncated frustoconical portion of the dish or base member of the carton includes a slot for receiving a tab on the cover in locking engagement therewith. The center portion of the cover includes a circular opening through which steam can escape from the interior of the base dish member of the food carton to preclude the contents of the carton from becoming soggy.

The unique shape of the base or dish enables the inverted conical compartment in the center of one dish to be nested within the steam opening in the cover of a carton positioned therebelow, thereby providing for stacking of the cartons either during storage or after they are filled with food. The cartons are locked in stacked relation by the inverted conical portion entering into the opening in a carton cover below, precluding relative movement of the stacked cartons.

Alternatively, in lieu of a conically shaped cover, the cover could be flat to permit more cartons to be stacked within a limited volume.

The carton of the present invention can also be made from a single, unitary, planar paperboard blank and can be folded either manually or on automatic machinery.

BRIEF DESCRIPTION OF THE DRAWINGS

Further objects and advantages of the present invention will become apparent from the following description and claims, and from the accompanying drawings, wherein:

FIG. 1 is a plan view of a blank for forming the food carton of the present invention;

FIG. 2 is a plan view of the blank of FIG. 1 partially folded to form the food carton of the present invention;

FIG. 3 is a cross-sectional view taken substantially along the plane indicated by line 3—3 of FIG. 2;

FIG. 4 is a partial plan view of the blank of FIG. 1 further folded in a subsequent step to form the food carton of the present invention;

FIG. 5 is a cross-sectional view taken substantially along the plane indicated by line 5—5 of FIG. 4;

FIG. 6 is a plan view of the blank of FIG. 1 completely folded to form the food carton of the present invention;

FIG. 7 is a perspective view of the food carton of the present invention;

FIG. 8 is a cross-sectional view taken substantially along the plane indicated by line 8—8 of FIG. 7; and FIG. 9 is a side view in elevation, with portions thereof removed and portions shown in section, of a plurality of stacked food cartons of the present invention.

DETAILED DESCRIPTION OF THE PREFERRED EMBODIMENT

Referring now to the drawings in detail, wherein like numerals indicate like elements throughout the several views, the food carton 10 of the present invention is assembled from a planar, paperboard, unitary blank 12 illustrated in FIG. 1.

The blank 12 includes a first circular panel 14 joined along its circumference by a hinge line 16 to a second panel 18 which constitutes a substantial sector of a circle on the order of about 300 degrees.

Circular panel 14 includes a central, concentric opening 20. The panel is cut radially along a line 22 extending from concentric opening 20 to the circumference 24 of panel 14. A substantially rectangular tab 26 is provided on both sides of cut line 22 along the circumference 24 of circular panel 14.

Sector panel 18 includes a pair of concentric perforated score lines 28 and 30, concentric to the circumference or outer edge 32 of the panel. The material between concentric score lines 28 and 30 forms an inner sector panel 32 while the material of panel 18 between circumference 32 and concentric score line 28 forms an outer sector panel 36. The material of panel 18 radially inwardly of score line 30 is a complete circle 38. Circular panel section 38 is cut along a radial line 40.

A notch 42 is cut in the circumference 34 of outer sector panel 36. The notch 42 includes inwardly extending sides 44 and 46. An angular slit 48 and 50 is also cut inwardly from the circumference 34 of outer panel sector 36 at spaced locations thereabout.

Blank 12 is folded as illustrated in FIGS. 2–6, inclusive, to form carton 10. The blank 12 is folded into carton 10 by overlapping portions of the outer sector panel 36 of panel 18 (see FIGS. 2 and 4) until the material on either side of angular cuts 48 and 50 is interlocked to secure the overlapped outer sector panel portions to each other, as shown in FIG. 4. This is accomplished by having the material of outer panel section 36 on one side of slit 48 inserted through slit 50 and vice versa. As this motion occurs, the inner concentric panel sector 32 of panel 18 is raised and pivots upwardly about score line 28 (see FIGS. 3 and 5) to form an inner truncated cone. The outer panel sector 36 forms a relatively inverted, truncated cone. The inner and outer truncated conical portions 32 and 36 are inverted with respect to each other as shown in FIG. 5 to form a dish-like compartment or base tray for receiving such fast food items as onion rings, fish sticks, french fries, or the like. The inner circular portion 38 is overlapped on either side of cut line 40 (see FIGS. 3 and 5) to form an inverted conical depression within the center portion of the base tray. The central conical portion 38 can be used to receive sauce into which the food housed within the base tray can be dunked. Circular portion 38 pivots downwardly about inner perforated scoreline 30 to form the inverted conical portion 38. If desired, adhesive can be applied to the overlapped portions of the truncated conical portion 36 and the inverted conical portion 38 to assure that the shape of the base tray is maintained.

Cover panel 14 is then bent about hinge line 16 to overlie the base tray of carton 10. Tabs 26 on either side of radial cut line 22 are overlapped and inserted in notch 42 (see FIGS. 6 and 7). The inwardly extending portions 44 and 46 surrounding notch 42 serve to catch the substantially rectangular overlapped tabs 26 to lock the cover to the base tray. The cover will also be substantially conical in shape and opening 20 permits steam generated by warm food within the base tray to escape to preclude the food from becoming soggy within the carton 10.

The apex 52 of the inverted, central conical portion 38 of the base tray 18 can be received within an opening 20 of a tray therebelow to stack and nest the trays as illustrated in FIG. 9. The insertion of apex 52 in opening 20 can be accomplished due to the conical shape of cover 14 and precludes the stacked cartons 10 from moving relative to each other.

If desired, cover 14 can be made separate from base tray panel 18 or the cover can be made flat rather than conical. Further, the parts can be assembled automatically utilizing machinery or can be manually assembled in the manner discussed.

What is claimed as new is:

1. A food carton comprising:

a dish-shaped base including a central depressed area, a first, truncated frustoconical panel concentric with the said central depressed area, a second, truncated frustoconical panel foldably connected to said first frustoconical portion and inverted with respect thereto, said first and second frustoconical panels forming a chamber for receiving a food product, while said central depressed area forms a reservoir for a liquid to be used in consuming said food product, and a cover element received in locking engagement on said dish-like base.

2. The carton of claim 1 wherein said cover is hingedly connected to said second, inverted truncated frustoconical panel of said base.

3. The carton of claim 2 wherein said cover includes a central opening therethrough.

4. The carton of claim 3 wherein said cover element is substantially conical in shape.

5. The carton of claim 4 wherein said central depressed area of said base is formed by a conical panel foldably connected and concentric with said first and second truncated frustoconical panels.

6. The carton of claim 5 wherein the circumference of said second, frustoconical panel includes a notch, and said cover element includes a tab received within said notch to secure said cover to said base in overlying relation thereto.

7. The carton of claim 6 wherein said tab is substantially rectangular in shape and formed by two like elements on either side of a radial line which are overlapped with each other.

8. A unitary, planar paperboard blank for forming the carton of claim 1.

9. A unitary, planar paperboard blank for forming the carton of claim 2.

10. A unitary, planar paperboard blank for forming the carton of claim 3.

11. A unitary, planar paperboard blank for forming the carton of claim 4.

12. A unitary, planar paperboard blank for forming the carton of claim 5.

13. A unitary, planar paperboard blank for forming the carton of claim 6.

14. A unitary, planar paperboard blank for forming the carton of claim 7.

* * * * *